US010571838B2

(12) United States Patent
Tajiri et al.

(10) Patent No.: US 10,571,838 B2
(45) Date of Patent: Feb. 25, 2020

(54) IMAGE FORMING APPARATUS

(71) Applicant: BROTHER KOGYO KABUSHIKI KAISHA, Nagoya-shi, Aichi-ken (JP)

(72) Inventors: Fumitake Tajiri, Nagoya (JP); Yusuke Mizuno, Nagoya (JP); Tatsuya Koyama, Toyoake (JP); Hisashi Tsukawaki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/283,900

(22) Filed: Feb. 25, 2019

(65) Prior Publication Data

US 2019/0265622 A1 Aug. 29, 2019

(30) Foreign Application Priority Data

Feb. 28, 2018 (JP) ..... 2018-035598
Feb. 28, 2018 (JP) ..... 2018-035641

(51) Int. Cl.
*G03G 15/20* (2006.01)
*G03G 15/00* (2006.01)

(52) U.S. Cl.
CPC ..... *G03G 15/2064* (2013.01); *G03G 15/2039* (2013.01); *G03G 15/657* (2013.01); *G03G 2215/2045* (2013.01)

(58) Field of Classification Search
None
See application file for complete search history.

(56) References Cited

U.S. PATENT DOCUMENTS

2014/0133888 A1* 5/2014 Ohshima ..... G03G 15/1685 399/176
2015/0277308 A1 10/2015 Honke et al.

FOREIGN PATENT DOCUMENTS

JP 2006-11120 A 1/2006
JP 2010-271410 A 12/2010
JP 2015-191154 A 11/2015

* cited by examiner

*Primary Examiner* — Victor Verbitsky
(74) *Attorney, Agent, or Firm* — Merchant & Gould P.C.

(57) ABSTRACT

A controller of an image forming apparatus executes acquisition processing of acquiring an area of an image which exists in a predetermined region of a first page where a developer image is first to be formed, heating processing of heating a heating member such that a temperature of the heating member reaches a fixing temperature, and feeding processing of starting feed of a sheet to a process unit after a predetermined period of time elapses from a predetermined timing after a start of print processing. The predetermined region is laid at both end portions in a width direction of the first page. In a case where the area of the image is equal to or smaller than a predetermined value, the controller sets the predetermined period of time in the feeding processing shorter as compared with a case where the area of the image is larger than the predetermined value.

20 Claims, 12 Drawing Sheets

IMAGE FORMING APPARATUS

CROSS-REFERENCE TO RELATED APPLICATION

This application claims priority from Japanese Patent Applications No. 2018-035598 filed on Feb. 28, 2018 and No. 2018-035641 filed on Feb. 28, 2018, the entire subject-matter of which is incorporated herein by reference.

TECHNICAL FIELD

The present disclosure relates to an image forming apparatus including a fixing device configured to heat a sheet and a sheet feeder configured to feed the sheet.

BACKGROUND

In a fixing device of an electrophotographic printer, when a temperature of a heating member of the fixing device is increased to a fixing temperature after a printing command is received, the temperature rise may be slower at both end portions of the heating member than at a central portion of the heating member. In this case, it is necessary to wait for printing start until the temperature of the end portions of the heating member becomes sufficiently high, specifically, the temperature of the end portions reaches a predetermined printing start temperature.

Regarding the above problem, in the related art, when a pixel density at an end portion of the sheet is equal to or smaller than a predetermined value, the printing starts even though the temperature of the end portions of the heating member is lower than a normal printing start temperature (refer to JP-A-2006-11120). Specifically, according to this technology, when the pixel density at an end portion of the sheet is equal to or smaller than the predetermined value, the printer waits until the temperature of the end portions of the heating member reaches a predetermined temperature lower than the printing start temperature and starts printing when the temperature reaches the predetermined temperature.

Also, in order to increase a printing speed, a feeding timing of the sheet is accelerated such that a time when the temperature of the heating member reaches a fixing temperature and a time when an image region on the sheet reaches the heating member are to be the same (refer to JP-A-2010-271410).

However, according to the technology disclosed in JP-A-2006-11120, since the timing of the printing start, i.e., the feeding timing of the sheet is decided on the basis of the temperature of the end portions of the heating member, the control is complicated.

Also, the heat may not be sufficiently accumulated in the heating member of the fixing device at the time that a printing starts and a first sheet reaches the heating member. In this case, the heat of the heating member is deprived at a head part of the sheet in a conveying direction, so that the temperature of the heating member is lowered and a fixing defect may be thus caused at a rear part of the sheet in the conveying direction. For this reason, when the heat has not been sufficiently accumulated in the heating member, the sheet feeding should start after the heat is sufficiently accumulated in the heating member. As a result, it is not possible to rapidly perform the printing.

SUMMARY

An object of the present disclosure is provide an image forming apparatus capable of simplifying a control of accelerating a feeding timing of a sheet in a case where an area of an image existing at an end portion of the sheet is small, or of rapidly performing a printing without waiting for heat accumulation in a heating member even though heat is not sufficiently accumulated in the heating member.

One illustrative aspect provides an image forming apparatus having:

a sheet feeder configured to feed a sheet;

a process unit configured to form a developer image on a sheet;

a heating member configured to heat a sheet; and a controller configured to, when the controller starts print processing, execute:

acquisition processing of acquiring an area of an image which exists in a predetermined region of a first page on which a developer image is first to be formed, the predetermined region being laid at both end portions in a width direction of the first page;

heating processing of heating the heating member such that a temperature of the heating member reaches a fixing temperature; and feeding processing of starting feed of a sheet to the process unit after a predetermined period of time elapses from a predetermined timing after a start of the print processing, in which in a case where the area of the image existing in the predetermined region is equal to or smaller than a predetermined value, the controller sets the predetermined period of time in the feeding processing shorter as compared with a case where the area of the image is larger than the predetermined value.

According to the above configuration, since it is possible to accelerate the feeding timing of the sheet simply by changing the predetermined period of time in the feeding processing, it is possible to simplify the control, as compared with the method of the related art where the feeding timing of the sheet is decided on the basis of the temperature of the end portions of the heating member. That is, it is possible to simplify the control of accelerating the feeding timing of the sheet in a case where an area of an image existing at an end portion of the sheet is small.

The predetermined timing may be a time when the controller starts the heating processing.

In the heating processing, the controller may be configured to execute:

first heating processing of heating the heating member such that the temperature of the heating member reaches a first temperature lower than the fixing temperature, with executing the acquisition processing; and second heating processing of heating the heating member such that the temperature of the heating member reaches the fixing temperature, after the first heating processing is over.

According to the above configuration, since the acquisition processing is executed during the first heating processing, it is possible to more rapidly start the printing.

The predetermined timing may be a time when the controller starts the second heating processing.

The predetermined timing may be a time when the temperature of the heating member reaches a second temperature lower than the fixing temperature after the heating processing starts.

The predetermined region may be a rectangular region having a predetermined width from both ends toward a center of the first page in the width direction and having a range from a head to a rear end in a conveying direction.

The predetermined region may be a region having a predetermined width from both ends toward a center of the first page in the width direction and having a predetermined length from a head of the first page in a conveying direction.

In the acquisition processing, the controller may be configured to execute development processing of developing printing data being received to object data represented as vector data or bitmap data, and acquire an area of a circumscribed rectangle of the object data existing in the predetermined region as the area of the image.

According to the above configuration, since it is possible to define the area of the image at the time that the printing data is developed to the object data, it is possible to accelerate the processing speed of the acquisition processing.

The predetermined value may be zero.

In the acquisition processing, the controller may acquire a number of dots of the image as the area of the image.

The other illustrative aspect provides an image forming apparatus having:

a sheet feeder configured to feed a sheet;

a process unit configured to form a developer image on a sheet;

a heating member configured to heat a sheet; and a controller configured to, when the controller starts print processing, execute:

acquisition processing of acquiring an area of an image which exists in a predetermined region of a first page, on which a developer image is first to be formed, the predetermined region being laid at a rear end portion in a conveying direction of the first page and at least at a rear side with respect to a central portion in the conveying direction;

heating processing of heating the heating member such that a temperature of the heating member reaches a fixing temperature; and feeding processing of starting feed of a sheet to the process unit after a predetermined period of time elapses from a predetermined timing after a start of the print processing, in which in a case where the area of the image existing in the predetermined region is equal to or smaller than a predetermined value, the controller sets the predetermined period of time in the feeding processing shorter as compared with a case where the area of the image is larger than the predetermined value.

In a case where the area of the image, which exists in the predetermined region of the rear end portion of the first page in the conveying direction, is equal to or smaller than the predetermined value, a fixing defect is difficult to occur even though a heat quantity to be applied to the rear part of the sheet in the conveying direction is small. For this reason, in a case where the area of the image, which exists in the predetermined region of the rear end portion of the first page in the conveying direction, is equal to or smaller than the predetermined value, the predetermined period of time is set shorter to accelerate a timing of feeding start of the first sheet, so that it is possible to rapidly perform the printing without waiting for heat accumulation in the heating member even though heat is not sufficiently accumulated in the heating member.

The predetermined timing may be a time when the controller starts the heating processing.

The predetermined timing may be a time when the temperature of the heating member reaches a second temperature lower than the fixing temperature after the heating processing starts.

The predetermined region may be a rectangular region having a predetermined length from a rear end toward a head of the first page in the conveying direction.

The predetermined region may be a rectangular region having a predetermined length from a rear end toward a head of the first page in the conveying direction and having a predetermined width from both ends toward a center of the first page in a width direction.

In the acquisition processing, the controller may be configured to execute development processing of developing printing data being received to object data represented as vector data or bitmap data, and acquire an area of a circumscribed rectangle of the object data existing in the predetermined region as the area of the image.

According to the above configuration, since it is possible to define the area of the image at the time that the printing data is developed to the object data, it is possible to accelerate the processing speed of the acquisition processing.

In the feeding processing, in a case where a plurality of sheets are printed, the controller may be configured to control the sheet feeder to feed the sheets such that an interval between the sheets to be fed is a predetermined separation, and in a case where the predetermined period of time is set shorter as compared with a case where the area of the image is larger than the predetermined value, the controller may be configured to the sheet feeder to feed the sheets such that an interval between a first sheet and a second sheet is larger than the predetermined separation.

According to the above configuration, since the interval between the first sheet and the second sheet is set large, the time after the first sheet is fixed until the second sheet reaches the heating member increases. Therefore, it is possible to sufficiently accumulate the heat in the heating member for the increased time, so that it is possible to suppress a fixing defect from occurring on the second sheet.

The image forming apparatus may further includes:

a pressing roller configured to press a sheet between the heating member and the pressing roller, in which the predetermined region is at a rear side region in the conveying direction with respect to a position where is distant from a head of the first page in the conveying direction by n times of a circumferential length of the pressing roller.

The controller may set the predetermined region to a larger region as a humidity or a sheet thickness is greater.

The greater the humidity or the sheet thickness is, the heating member is more likely to be deprived of the heat by the sheet. Therefore, when the humidity or the sheet thickness is larger, the predetermined region is set larger, so that it is possible to suppress a fixing defect from occurring on the first sheet.

The other illustrative aspect provides an image forming apparatus having:

a sheet feeder configured to feed a sheet;

a process unit configured to form a developer image on a sheet;

a heating roller configured to heat a sheet;

a pressing roller configured to press a sheet between the heating roller and the pressing roller;

a halogen heater configured to heat the heating roller; and a controller configured to, when the controller starts print processing, execute:

acquisition processing of acquiring an area of an image which exists in a predetermined region of a first page on which a developer image is first to be formed, the predetermined region being laid at both end portions in a width direction of the first page;

heating processing of energizing the halogen heater such that a temperature of the heating roller reaches a fixing temperature; and feeding processing of starting feed of a sheet to the process unit after a predetermined period of time elapses from a predetermined timing after a start of the print processing, in which in a case where the area of the image existing in the predetermined region is equal to or smaller than a predetermined value, the controller sets the predetermined period of time in the feeding processing shorter as compared with a case where the area of the image is larger than the predetermined value.

DETAILED DESCRIPTION

Hereinafter, an illustrative embodiment of the present disclosure will be described in detail with reference to the drawings.

Figure 1:
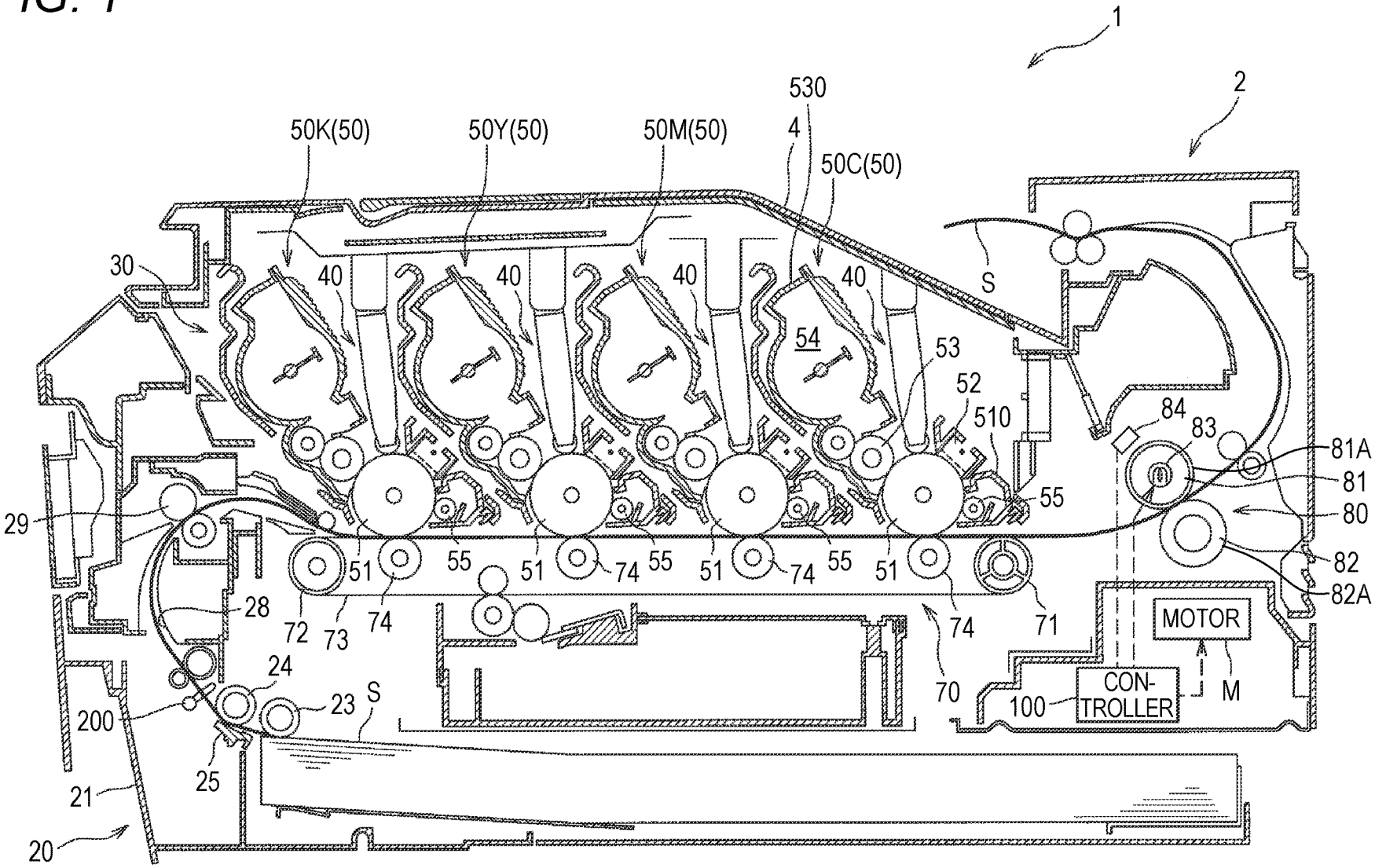
FIG. 1 is a sectional view depicting a color printer in accordance with an illustrative embodiment of the present disclosure.

As shown in FIG. 1, a color printer 1 is an example of the image forming apparatus configured to form an image on a sheet S, and includes, in a body housing 2, a sheet conveying unit 20, a process unit 30, a fixing device 80, and a controller 100.

The sheet conveying unit 20 includes a feeding tray 21, a pickup roller 23 as an example of the sheet feeder, a separation roller 24, a separation pad 25, and registration rollers 29. The sheet conveying unit 20 is configured to feed the sheets S in the feeding tray 21 toward the separation roller 24 by the pickup roller 23, and to separate the sheets S one by one between the separation roller 24 and the separation pad 25. Specifically, the pickup roller 23 is a roller capable of switching a stationary state and a conveying state of the sheet S, and is configured to start rotation from a stop state where it is in contact with the sheet S in the feeding tray 21, thereby delivering the sheet S in the feeding tray 21. The registration rollers 29 are configured to align a position of a tip end of the sheet S and to convey the sheet S toward the process unit 30. Specifically, the registration rollers 29 are configured to contact the conveyed sheet S in a stop state, to align the position of the tip end of the sheet S and to start rotation thereof, thereby delivering the sheet S. The sheet S delivered by the sheet conveying unit 20 passes through the process unit 30 and the fixing device 80 and is conveyed to an outside of the color printer 1.

The process unit 30 is a unit configured to form a developer image on the sheet S, and includes four LED units 40, four process cartridges 50, and a transfer unit 70.

The LED unit 40 is an exposure device including a plurality of light-emitting units aligned side by side in a right and left direction.

The process cartridge 50 includes a drum cartridge 510 and a developing unit 530. The drum cartridge 510 includes a photosensitive drum 51, a charger 52, and a cleaning roller 55. The developing unit 530 includes a developing roller 53, and a developer accommodation chamber 54 configured to accommodate therein developer.

The process cartridges 50 in which toners of respective colors of black, yellow, magenta and cyan are accommodated are denoted with reference numerals of 50K, 50Y, 50M, 50C, and are arranged in corresponding order from an upstream side with respect to the conveying direction of the sheet S.

The transfer unit 70 includes a drive roller 71, a driven roller 72, a conveyor belt 73, and transfer rollers 74.

The drive roller 71 and the driven roller 72 are arranged in parallel with each other with being spaced in a front and rear direction, and the conveyor belt 73 configured by an endless belt is wound therebetween. At an inner side of the conveyor belt 73, the four transfer rollers 74 configured to sandwich the conveyor belt 73 between the transfer rollers and the respective photosensitive drums 51 are arranged to face the respective photosensitive drums 51.

In the process unit 30 configured as described above, a surface of each photosensitive drum 51 is charged by the charger 52 and is then exposed by the LED unit 40. Thereby, an electrostatic latent image based on image data is formed on each photosensitive drum 51. Thereafter, toner is supplied from the developing roller 53 to the electrostatic latent image, so that a developer image is formed on the photosensitive drum 51. The sheet S fed onto the conveyor belt 73 passes between each photosensitive drum 51 and each transfer roller 74, so that the developer images formed on the respective photosensitive drums 51 are transferred onto the sheet S.

The fixing device 80 is arranged downstream of the process unit 30 with respect to the conveying direction of the sheet S. The fixing device 80 includes a heating member 81 configured to heat the sheet S and to fix the developer image on the sheet S and a pressing member 82 configured to press the sheet S between the heating member 81 and the pressing member 82. The heating member 81 is a cylindrical heating roller and is made of metal or the like. The heating member 81 includes an elastic layer 81A provided on a surface of the cylindrical heating roller. In the heating member 81, a heater 83 for heating the heating member 81 is provided. As the heater 83, a halogen heater having a filament (resistive element) and configured to heat a range of the heating member 81, through which the sheet S is to pass, by radiation heat can be adopted. The pressing member 82 is a pressing roller having an elastic layer 82A provided on a surface thereof.

The heating member 81 and the pressing member 82 are configured to rotate by a drive force applied from a motor M that is controlled by the controller 100. The fixing device 80 is configured to heat the sheet S and to fix the developer image on the sheet S by the heater 83 while sandwiching and conveying the sheet S between the heating member 81 and the pressing member 82 being rotating.

Also, the fixing device 80 includes a temperature detector 84 configured to detect a temperature of the heating member 81. The temperature detector 84 is arranged to face a surface of the heating member 81 in a contactless manner. The temperature detected by the temperature detector 84 is output to the controller 100. The controller 100 is configured to acquire the temperature of the heating member 81, based on a detection result of the temperature detector 84.

Figure 2:
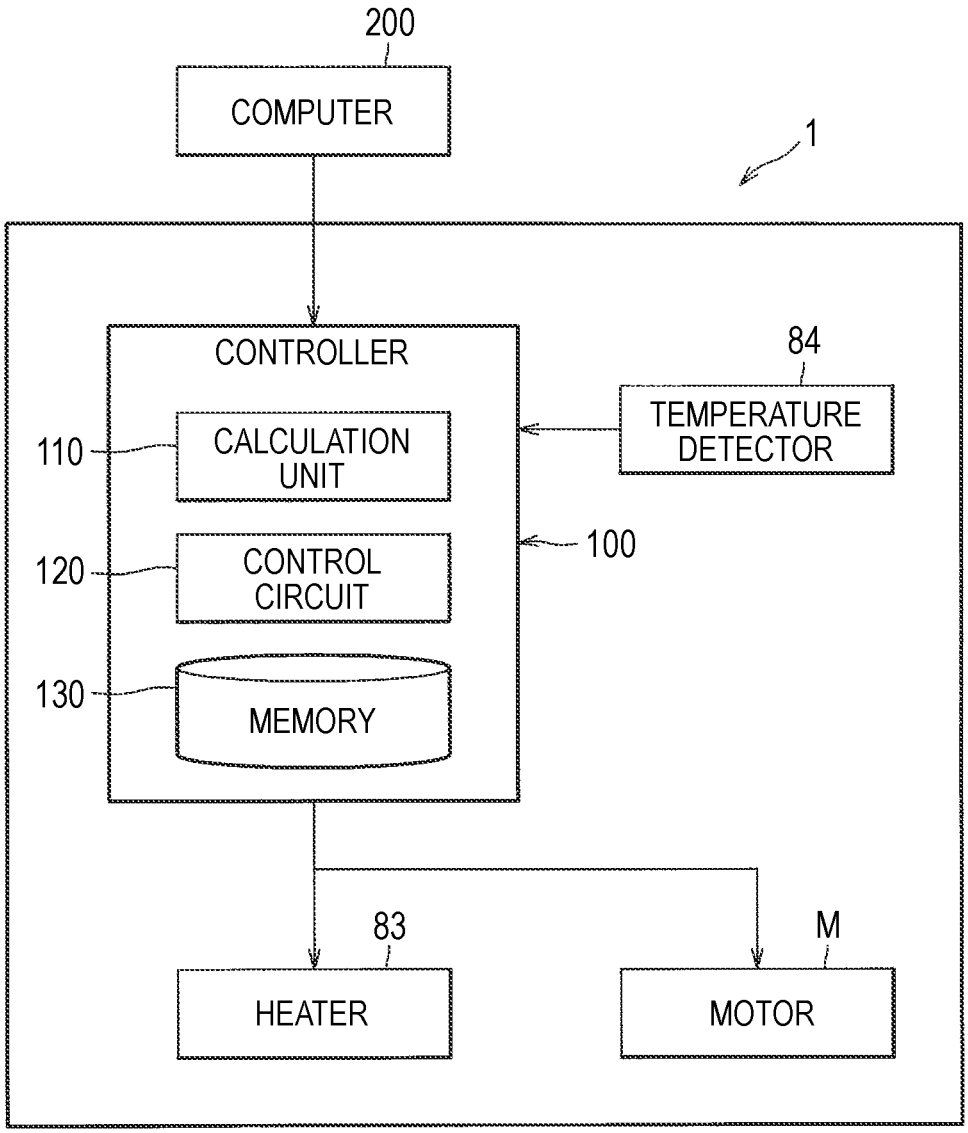
FIG. 2 is a block diagram depicting a configuration of a controller.

As shown in FIG. 2, the controller 100 includes a CPU, a RAM, a ROM and an input/output circuit, and is configured to execute control by performing a variety of calculation processing on the basis of a printing command to be output from an external computer 200, information to be output from the temperature detector 84 and a program and data stored in the ROM and the like. Specifically, the controller 100 includes a calculation unit 110 such as a CPU and the like, a control circuit 120 configured to control the heater 83, the motor M and the like, and a memory 130 such as a RAM, a ROM and the like.

The controller 100 is configured to execute acquisition processing, heating processing and feeding processing. The acquisition processing is processing of acquiring an area of an image which exists in a predetermined region of a first page, on which the developer image is first to be formed, based on the printing data being received. The controller 100 is configured to execute first acquisition processing and second acquisition processing in which the predetermined region is differently set, as the acquisition processing. The controller 100 is configured to execute one or both of the first acquisition processing and the second acquisition processing at the same time.

The heating processing is processing of heating the heating member 81 such that the temperature of the heating member 81 reaches a fixing temperature. The fixing temperature is a temperature that is set in correspondence to a thickness, a conveying speed and the like of the sheet S so as to fix the developer image, which has been formed on the sheet S, on the sheet S and is set to a predetermined fixing temperature TH, in the illustrative embodiment. In the heating processing, the controller 100 is configured to execute first heating processing of heating the heating member 81 such that the temperature of the heating member 81 reaches a first temperature T1 lower than the fixing temperature TH, and second heating processing of heating the heating member 81 such that the temperature of the heating member 81 reaches the fixing temperature TH after the first heating processing is over.

Specifically, when the printing data is received, the controller 100 executes the first heating processing with executing the first acquisition processing or the second acquisition processing, which will be described later. Also, in the first heating processing, the controller 100 is configured to set a target value of the temperature of the heating member 81 to the first temperature T1 and to control energization to the heater 83 such that the temperature (hereinafter, referred to as 'detected temperature Ts') of the heating member 81 detected by the temperature detector 84 reaches the first temperature T1. When a predetermined specified time ZA elapses after the start of the first heating processing and development processing (which will be described later) is completed, the controller 100 ends the first heating processing and starts the second heating processing. In the second heating processing, the controller 100 is configured to set the target value of the temperature of the heating member 81 to the fixing temperature TH and to control energization to the heater 83 such that the detected temperature Ts reaches the fixing temperature TH.

The feeding processing is processing of starting feed of the sheet S by the pickup roller 23 after a predetermined period of time Zth has elapsed from a predetermined timing. In the illustrative embodiment, it is assumed that the predetermined timing is a time when the controller 100 starts the second heating processing. Also, when printing a plurality of sheets S, the controller 100 feeds the sheets S such that each interval between the plurality of sheets S is to be a predetermined separation, in the feeding processing. Also, the controller 100 is configured to rotate the motor M at the predetermined timing, thereby starting drive of the fixing device 80, specifically, rotations of the heating member 81 and the pressing member 82.

Figure 3A:
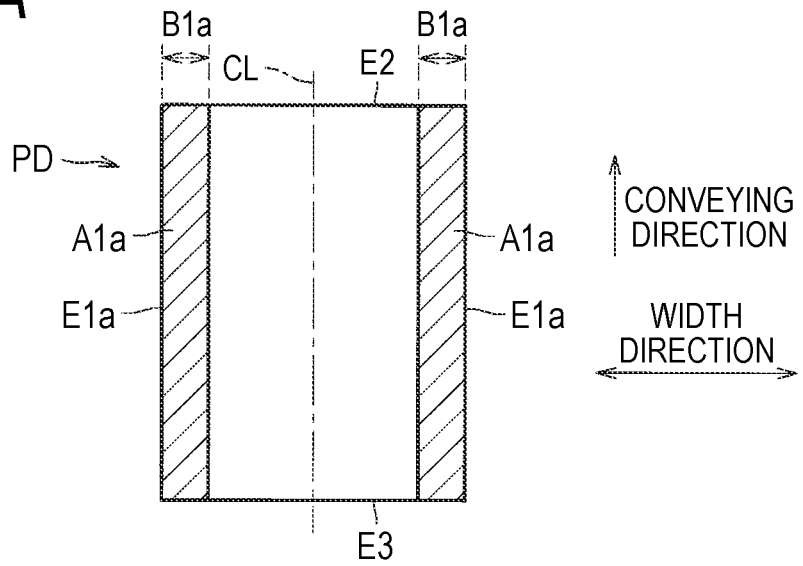
FIGS. 3A, 3B and 3C depict examples of a predetermined region in first acquisition processing.

The first acquisition processing is processing of acquiring an area of an image which exists in a predetermined region of a first page, on which the developer image is first to be formed, based on the printing data being received. The predetermined region is laid at both end portions in a width direction of the first page. In the below, data, which corresponds to one page, of the printing data is described as page data. Here, as shown in FIG. 3A, the width direction is a direction along a width of the page data PD, i.e., a width of the sheet S, and is perpendicular to the conveying direction of the sheet S. Also, both end portions of the page data PD in the width direction indicate both end portions on the basis of a central line CL located at a center of the page data PD in the width direction. Here, the sheet S is conveyed in a state where a center of the sheet S in the width direction and the central line CL coincide with each other, irrespective of a dimension in the width direction.

Figure 3B:
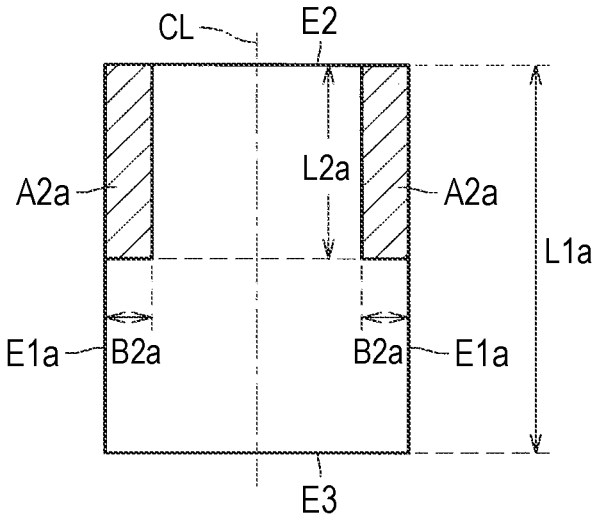
Figure 3C:
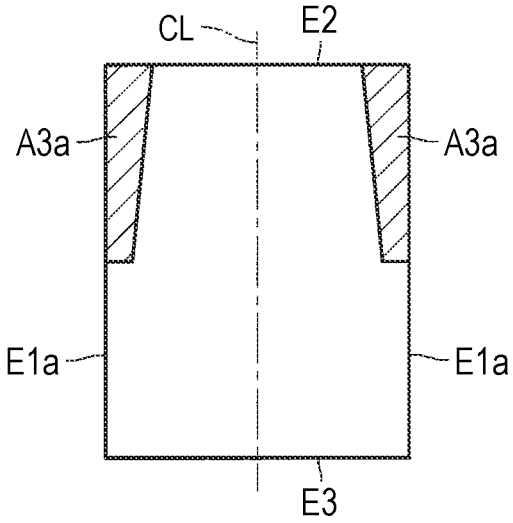

The predetermined region can be set as a region that is distant from the central line CL by 90 mm or longer when a maximum width of the sheet S, which can be printed by the color printer 1, is A4 or a letter/legal width, for example. Specifically, the predetermined region can be set as regions as shown in FIGS. 3A to 3C, for example.

The predetermined region A1*a* shown in FIG. 3A is a rectangular region having a predetermined width B1*a* from both ends E1*a* in the width direction of the first page of the printing data toward the center, i.e., the central line CL, and ranging from a head E2 to a rear end E3 in the conveying direction. The predetermined region A2*a* shown in FIG. 3B is a region having a predetermined width B2*a* from both ends E1*a* in the width direction of the first page of the printing data toward the central line CL, and a predetermined length L2*a* from the head E2 in the conveying direction of the first page of the printing data. Here, the length L2*a* is smaller than a length L1*a* of the page data PD in the conveying direction. The predetermined region A3*a* shown in FIG. 3C is a region of which a width decreases from the head E2 in the conveying direction of the first page of the printing data toward the rear end E3.

The second acquisition processing is processing of acquiring an area of an image which exists in a predetermined region of a first page, on which the developer image is first to be formed, based on the printing data being received. The predetermined region is laid at a rear end portion in the conveying direction of the first page and at least at the rear side with respect to the central portion in the conveying direction. In the below, data, which corresponds to one page, of the printing data is described as page data. The predetermined region can be set as regions as shown in FIGS. 4A to 4C, for example.

Figure 4A:
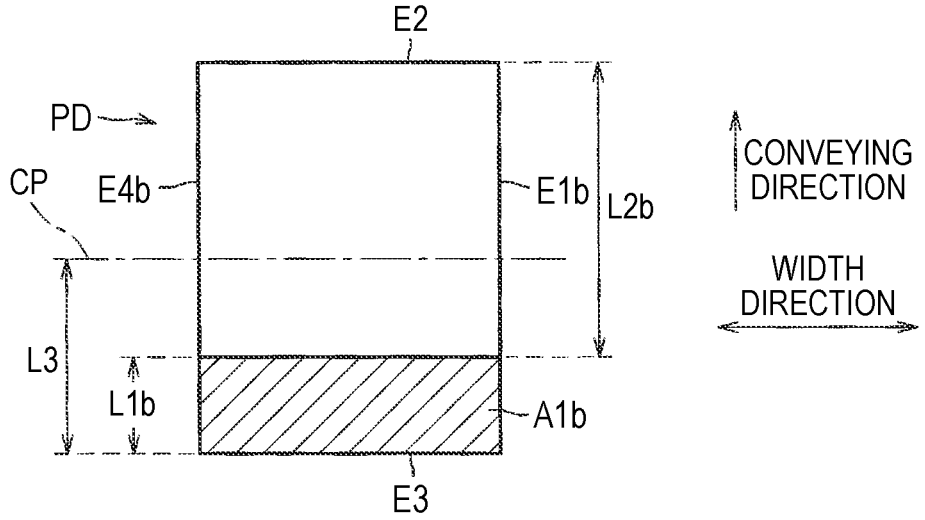
FIGS. 4A, 4B and 4C depict examples of the predetermined region in second acquisition processing.
Figure 4B:
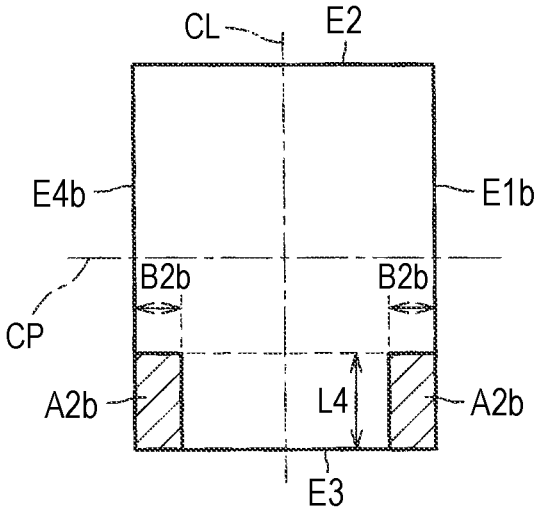
Figure 4C:
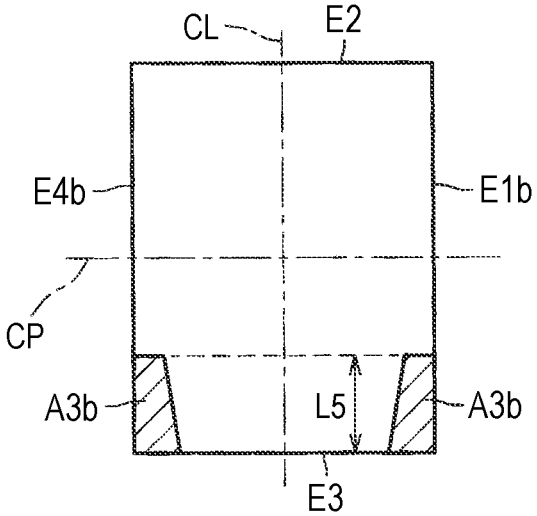

The predetermined region A1*b* shown in FIG. 4A is a rectangular region having a predetermined length L1*b* from the rear end E3 in the conveying direction of the first page data PD of the printing data toward the head E2 in the conveying direction. The length L1*b* is smaller than a length L3 from the central portion CP of the page data PD in the conveying direction to the rear end E3 in the conveying direction. The predetermined region A1*b* is set from one end E1*b* of the page data PD to the other end E4*b* in the width direction.

Here, the width direction is a direction along the width of the page data PD, i.e., the width of the sheet S, and is perpendicular to the conveying direction of the sheet S. Also, both ends E1*b*, E4*b* of the page data PD in the width direction indicate both ends E1*b*, E4*b* on the basis of the central line CL located at the center of the page data PD in the width direction. Here, the sheet S is conveyed in the state where the center of the sheet S in the width direction and the central line CL coincide with each other, irrespective of a dimension in the width direction.

Also, a distance L2*b* from the head E2 of the page data PD in the conveying direction to the predetermined region A1*b* is greater than n times of a circumferential length of the pressing member 82, which is the pressing roller. That is, the predetermined region A1*b* is set as a rear region in the conveying direction of a position, which is distant from the head E2 of the page data PD in the conveying direction by a distance of n times of the circumferential length of the pressing member 82.

Here, n is a natural number and can be appropriately set by a test and the like, in correspondence to an amount of accumulated heat of the pressing member 82. Here, the amount of accumulated heat of the pressing member 82 gradually decreases because the heat is deprived by the sheet S while the sheet S is fixed from a head side in the conveying direction. The natural number n can be set from the number of rotation times of the pressing member 82 at the time that the amount of accumulated heat of the pressing member 82 is reduced to a limit suitable for the fixing of the sheet S.

The predetermined region A2*b* shown in FIG. 4B is a rectangular region having a predetermined length L4 from the rear end E3 in the conveying direction of the first page data PD of the printing data toward the head E2 in the conveying direction and a predetermined width B2*b* from both ends E1*b*, E4*b* in the width direction toward the center, i.e., the central line CL. The predetermined region A2*b* can be set as a region that is distant from the central line CL by 90 mm or longer when the maximum width of the sheet S, which can be printed by the color printer 1, is A4 or a letter/legal width, for example.

The predetermined region A3*b* shown in FIG. 4C is a region of which a width decreases from the rear end E3 in the conveying direction of the first page data PD of the printing data toward the head E2 in the conveying direction. The predetermined region A3*b* is respectively provided at one end E1*b* and the other end E4*b* in the width direction of the first page data PD of the printing data, and has a predetermined length L5 from the rear end E3 in the conveying direction toward the head E2 in the conveying direction.

Figure 5:
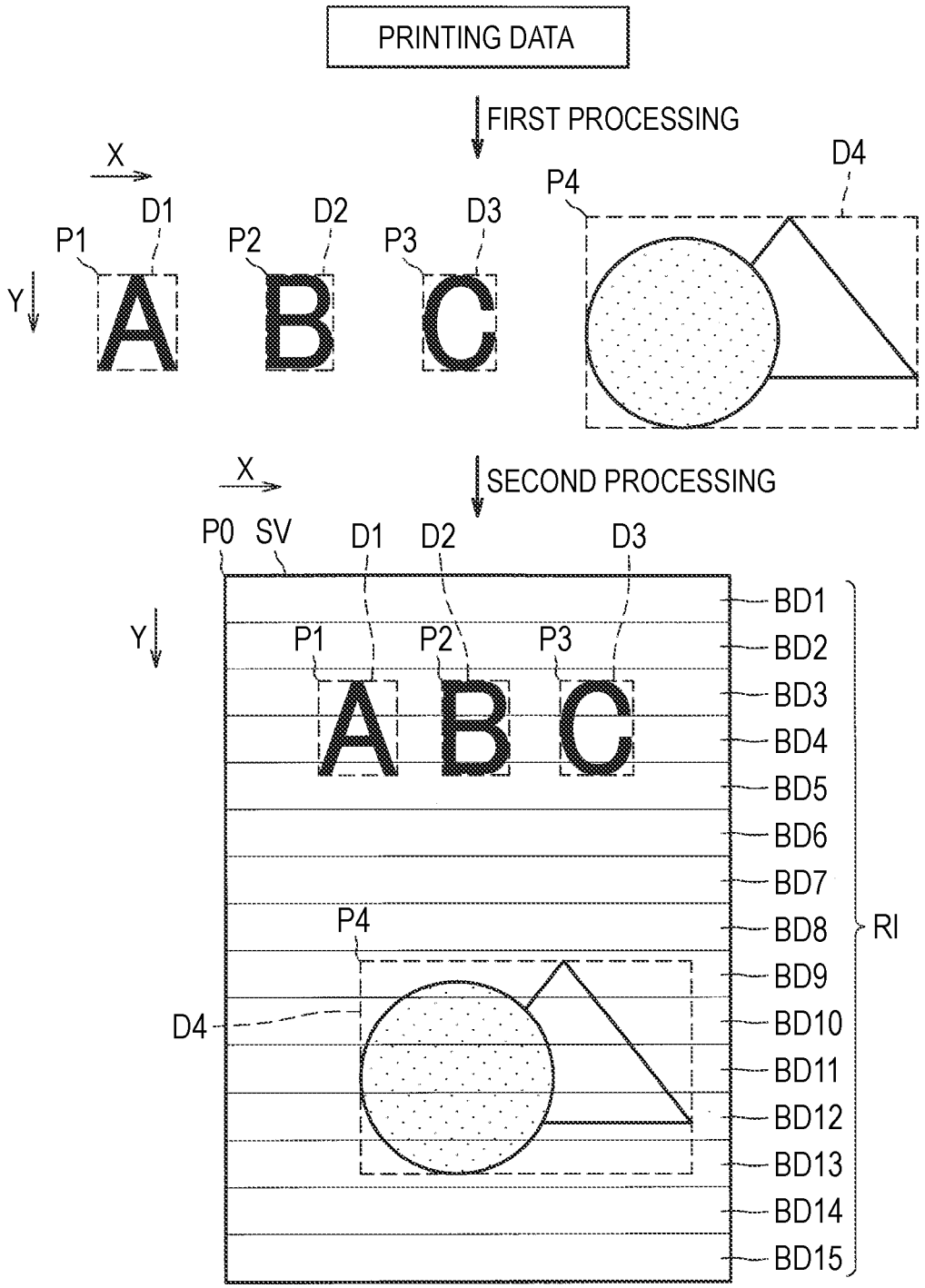
FIG. 5 depicts development processing of developing printing data to a raster image.

In the first acquisition processing and the second acquisition processing, the controller 100 is configured to execute development processing. The development processing is processing of developing the received printing data to a raster image. As shown in FIG. 5, in the development processing, the controller 100 executes first processing of developing the printing data being received to object data D1 to D4 represented as vector data or bitmap data and second processing of arranging the object data D1 to D4 in a virtual sheet SV and developing the same to a raster image RI including a plurality of band data BD1 to BD15.

Here, the printing data is data that is prepared by an external device such as a computer and is configured by a page description language or the like, and cannot be treated as data for exposure of the color printer 1. Therefore, the controller 100 is configured to execute the development processing of developing the printing data configured by the page description language or the like to the raster image RI that is data for exposure.

The object data D1 to D4 is vector data or bitmap data. In the vector data, vector information becoming an outline and a fill are defined. The object data D1 to D4 is associated with position information on the virtual sheet SV, a size and the like. In the first processing, the received printing data is developed, and a coordinate P positioned at one apex of a rectangular frame circumscribed about each of the object data D1 to D4, and sizes of the width direction (X direction) and the conveying direction (Y direction) are acquired. In FIG. 5, an origin coordinate P0 of the virtual sheet SV, and start point coordinates of the object data D1 to D4 on the virtual sheet SV are denoted with P1 to P4.

Each of the band data BD1 to BD15 includes a predetermined number of (ten, for example) line data. That is, the raster image RI includes a plurality of line data. The line data is binary data corresponding to ON/OFF of the plurality of light-emitting units of each LED unit 40, and corresponds to a plurality of dots of the electrostatic latent image formed in a rotation axis direction of the photosensitive drum 51. In the second processing, the controller 100 arranges the respective object data D1 to D4 on the virtual sheet SV on the basis of the position information, and generates sequentially the band data BD1 to BD15, specifically, the line data from one end portion of the virtual sheet SV in the conveying direction. When generating the line data, the controller 100 refers to all the object data included in the line. The controller 100 executes the development processing for each pages of the sheets S.

After the development processing, the controller 100 is configured to acquire an area of the circumscribed rectangle of the object data existing in the predetermined region, as an area of an image existing in the predetermined region. Specifically, when a part of the circumscribed rectangle of the object data is located in the predetermined region and the other part is located outside the predetermined region, the controller 100 acquires an area of the part of the circumscribed rectangle, as the area of the image in the predetermined region.

Also, in the development processing, the controller 100 is configured to develop the object data for each color and to acquire, as the area of the image in the predetermined region, a value obtained by adding the area of the circumscribed rectangle of the object data of each color existing in the predetermined region. Here, even when the circumscribed rectangles of the object data of the respective colors are arranged with overlapping with each other in the predetermined region, the controller 100 calculates the area of the circumscribed rectangle of the object data for each color and adds the area.

The controller 100 has functions of determining whether the area of the image acquired in the first acquisition processing or the second acquisition processing is equal to or smaller than a predetermined value, and when it is determined that the area is equal to or smaller than the predetermined value, setting a predetermined period of time Zth in the feeding processing shorter as compared with a case where the area is larger than the predetermined value. Specifically, when the area of the image acquired in the first acquisition processing or the second acquisition processing is equal to or smaller than the predetermined value, the controller 100 sets the predetermined period of time Zth to a first time Z1, and when the area is larger than the predetermined value, the controller 100 sets the predetermined period of time Zth to a second time Z2 longer than the first time Z1. In the meantime, the predetermined value may be arbitrarily set and may be set to zero (0), for example.

Subsequently, the operation of the controller 100 is described in detail. The controller 100 controls the heater 83 and the motor M in accordance with a flowchart shown in FIG. 6, and controls drive/stop of the pickup roller 23 in accordance with a flowchart shown in FIG. 7.

Figure 6:
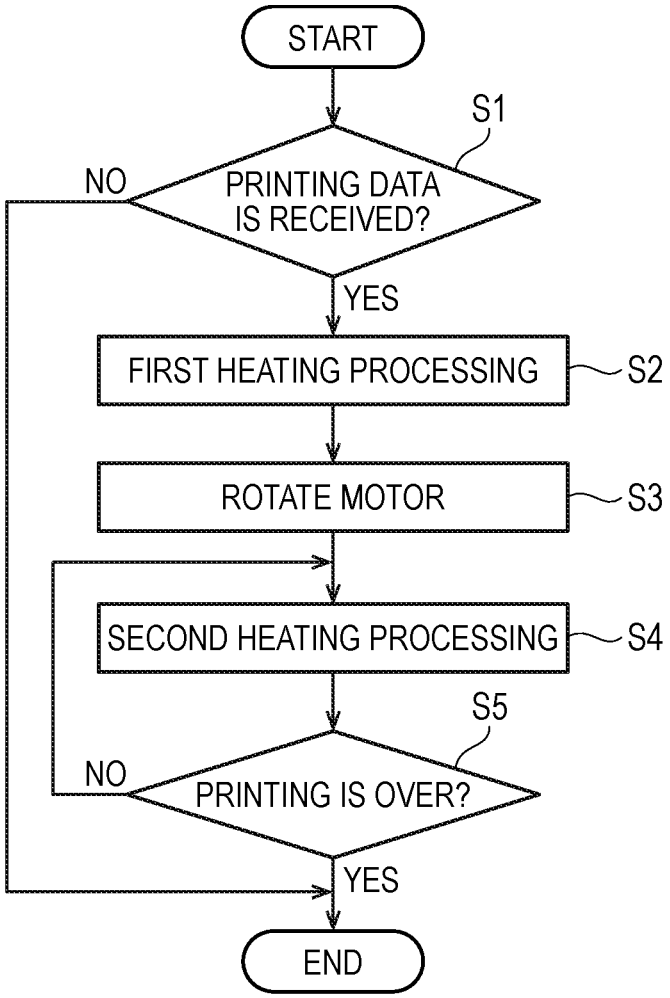
FIG. 6 is a flowchart depicting control of a heater and a motor.

As shown in FIG. 6, the controller 100 determines whether printing data has been received (S1). When it is determined in step S1 that the printing data has not been received (No), the controller 100 ends the control.

When it is determined in step S1 that the printing data has been received (Yes), the controller 100 starts the first heating processing (S2). In step S2, the controller 100 determines a first condition that the specified time ZA has elapsed from the start of the first heating processing and a second condition that the development processing has been completed, and ends the first heating processing when it is determined that both the first condition and the second condition are satisfied.

After step S2, the controller 100 rotates the motor M to rotate the heating member 81 and the pressing member 82 (S3).

After step S3, the controller 100 starts the second heating processing (S4). After step S4, the controller 100 determines whether the printing has been over (S5). When it is determined in step S5 that the printing has not been over (No), the controller 100 returns to the processing of step S4. When it is determined in step S5 that the printing has been over (Yes), the controller 100 ends the control.

Figure 7:
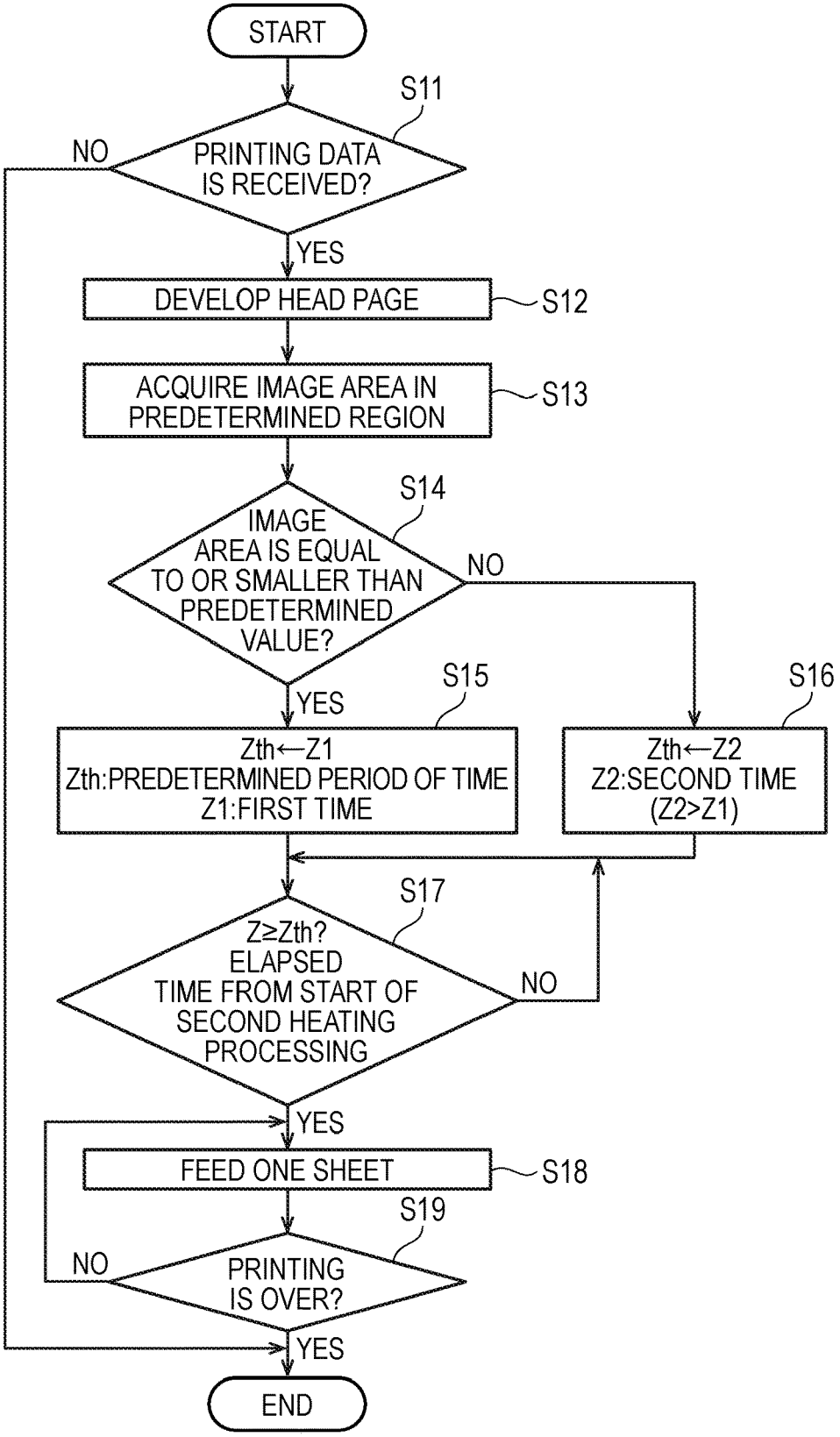
FIG. 7 is a flowchart depicting control of drive/stop of a pickup roller.

In the control of FIG. 7, the controller 100 determines whether printing data has been received (S11). In the illustrative embodiment, when the printing data is received, the print processing starts. When it is determined in step S11 that the printing data has not been received (No), the controller 100 ends the control.

When it is determined in step S11 that the printing data has been received (Yes), the controller 100 starts the development processing for the first page of the printing data (S12). After step S12, the controller 100 acquires the area of the image existing in the predetermined region of both end portions of the first page in the width direction (the predetermined region A1*a* shown in FIG. 4A) or the predetermined region of the rear end portion of the first page in the conveying direction (the predetermined region A1*b* shown in FIG. 4A) (S13).

After step S13, the controller 100 determines whether the area of the image acquired in step S13 is equal to or smaller than the predetermined value (S14). When it is determined in step S14 that the area of the image is equal to or smaller than the predetermined value (Yes), the controller 100 sets the predetermined period of time Zth to the first time Z1 (S15). When it is determined in step S14 that the area of the image is not equal to or smaller than the predetermined value (No), the controller 100 sets the predetermined period of time Zth to the second time Z2 longer than the first time Z1 (S16).

After step S15 or step S16, the controller 100 determines whether the elapsed time Z from the start of the second heating processing is equal to or longer than the predetermined period of time Zth (S17). The controller 100 repetitively executes the processing of step S17 until it is determined in step S17 that a relation of Z≥Zth is satisfied (No). When it is determined that a relation of Z≥Zth is satisfied (Yes), the controller 100 drives the pickup roller 23 to feed one sheet S (S18).

After step S18, the controller 100 determines whether the printing has been over (S19). When it is determined in step S19 that the printing has not been over (No), the controller 100 returns to the processing of step S18, and feeds the second sheet S and thereafter at predetermined timings. Specifically, the second sheet S and thereafter are fed at preset timings in such a manner that this sheet S is fed after predetermined period of time has elapsed from the previous feeding of the sheet S such that an interval between the sheets S is a predetermined separation, for example.

When it is determined in step S19 that the printing data has been received (Yes), the controller 100 ends the control.

Subsequently, an example of the operation of the controller 100 in a ready mode is described with reference to FIG. 8. The ready mode is a state where the heating member 81 is kept at a ready temperature TR lower than the fixing temperature TH so as to execute the printing in a relatively short time when the printing data is received.

Figure 8:
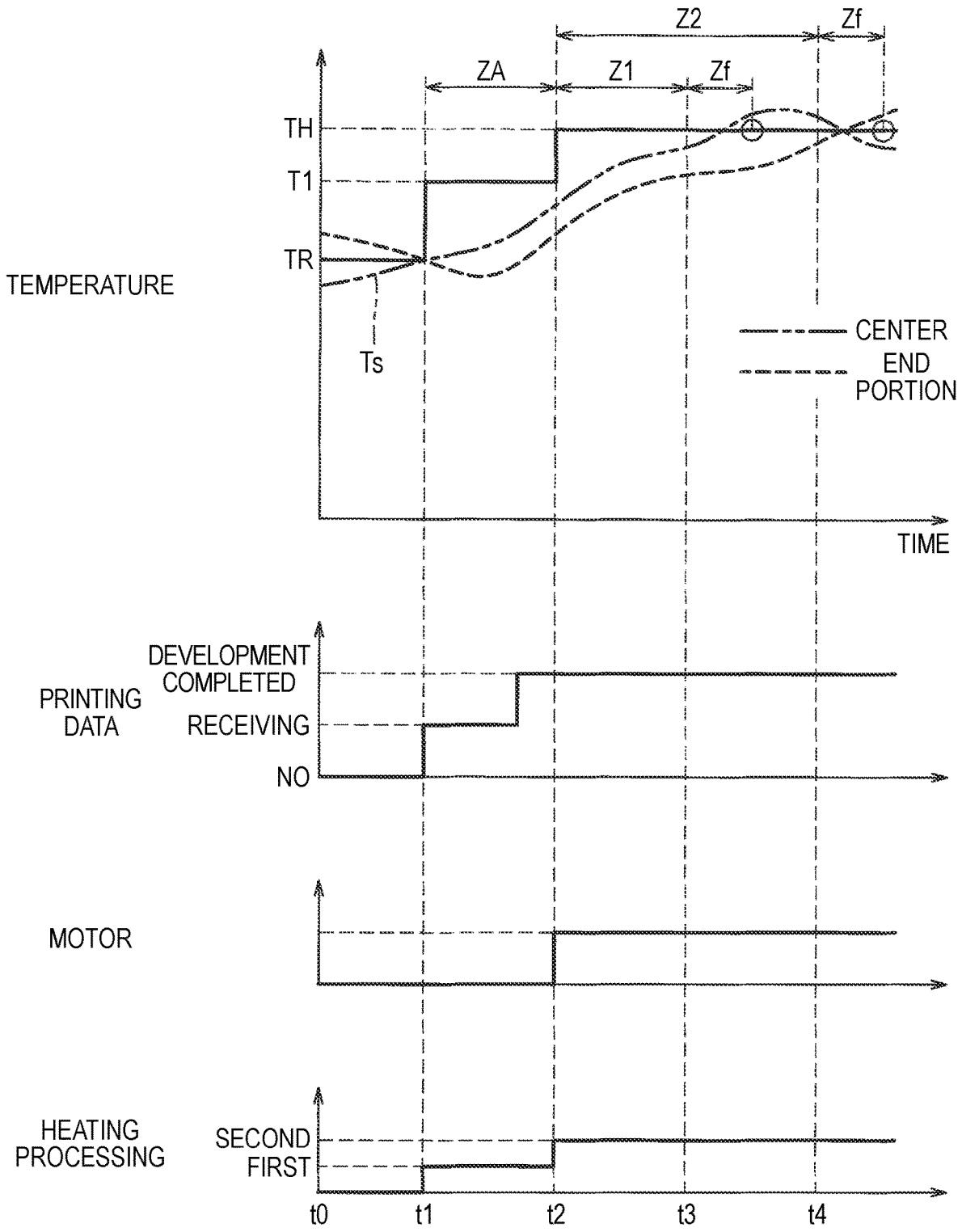
FIG. 8 is a timing chart depicting an example of an operation of the controller.

As shown in FIG. 8, in the ready mode (time t0 to t1), the controller 100 controls energization to the heater 83 such that the detected temperature Ts is to be the predetermined ready temperature TR. Here, in the illustrative embodiment, it is assumed that the temperature detector 84 is arranged at a center of the heating member 81 in the width direction and detects a temperature of the center of the heating member 81 in the width direction. Here, the center in the width direction is a region closer to the central line CL than the predetermined region of both end portions in the width direction, and can be set as a region having a width of 90 mm or smaller from the central line CL when the maximum width of the sheet S, which can be printed by the color printer 1, is A4 or a letter/legal width. The temperature detector 84 is preferably arranged at a position distant from the central line CL by 20 mm or smaller.

When the printing data is received in the ready mode (time t1), the controller 100 starts the first heating processing and the first acquisition processing or the second acquisition processing. When the area of the image existing in the predetermined region, which is acquired in the first acquisition processing or the second acquisition processing, is equal to or smaller than the predetermined value, the controller 100 sets the first time Z1, as the predetermined period of time Zth in the feeding processing, and when the area of the image is larger than the predetermined value, the controller 100 sets the second time Z2 longer than the first time Z1, as the predetermined period of time Zth.

When the specified time ZA elapses from the start of the first heating processing and the development processing is completed, the controller 100 shifts from the first heating processing to the second heating processing and rotates the motor M to rotate the heating member 81 and the pressing member 82 (time t2). Then, when the predetermined period of time Zth (Z1 or Z2) elapses from the start (time t2) of the second heating processing, the controller 100 starts the feed of the sheet S (time t3 or time t4). Thereby, during the predetermined period of time Zth, it is possible to accumulate the heat from the heater 83 in the pressing member 82.

Here, a heat distribution of the heating member 81 after the start of the heating processing has such a tendency that the heat is higher at the center in the width direction than at both end portions. Thereby, the temperature of the end portion of the heating member 81 shown with the broken line in FIG. 9 reaches the fixing temperature TH at a later timing, as compared with the center temperature shown with the dashed-two dotted line. For this reason, when the area of the image existing in the predetermined region of both end portions of the first page in the width direction is larger than the predetermined value, the predetermined period of time Zth in the feeding processing is set to the second time Z2, so that after the temperature of the end portion of the heating member 81 rises to about the fixing temperature TH, the feeding of the sheet S starts. In this case, since the temperature of the end portion of the heating member 81 has reached the fixing temperature TH at the time that the feeding time Zf after the feeding of the sheet S starts until the sheet S reaches the heating member 81 has elapsed, it is possible to favorably fix the image formed at both end portions of the sheet S in the width direction.

On the other hand, when the area of the image existing in the predetermined region of both end portions of the first page in the width direction is equal to or smaller than the predetermined value, it is possible to sufficiently perform the fixing even though the heat quantity that is applied to an image at the end portion of the sheet S in the width direction is small. For this reason, in this case, the predetermined period of time Zth in the feeding processing is set to the first time Z1 shorter than the second time Z2, so that it is possible to start the feeding of the sheet S and to rapidly start the printing without waiting that the temperature of the end portion of the heating member 81 is to rise to about the fixing temperature TH. In this case, since the center temperature of the heating member 81 has reached the fixing temperature TH at the time that the feeding time Zf after the feeding of the sheet S starts until the sheet S reaches the heating member 81 has elapsed, it is possible to favorably perform the fixing when the area of the image at both end portions of the sheet S in the width direction is equal to or smaller than the predetermined value.

Also, when the area of the image existing in the predetermined region of the rear end portion of the first page in the conveying direction is equal to or smaller than the predetermined value, a fixing defect is difficult to occur even though the heat quantity that is applied to the rear part of the sheet in the conveying direction is small. For this reason, when the area of the image existing in the predetermined region of the rear end portion of the first page in the conveying direction is equal to or smaller than the predetermined value, the predetermined period of time Zth is set to the short first time Z1 to accelerate the timing of the feeding start of the first sheet S, so that it is possible to rapidly perform the printing without waiting for the heat accumulation in the heating member 81 or the pressing member 82 even though the heat has not been sufficiently accumulated in the heating member 81 or the pressing member 82.

According to the illustrative embodiment as described above, it is possible to accomplish following effects.

Since it is possible to accelerate the feeding timing of the sheet S simply by changing the predetermined period of time Zth in the feeding processing, it is possible to simplify the control, as compared with the method of the related art where the feeding timing of the sheet is decided on the basis of the temperature of the end portion of the heating member.

Since the first acquisition processing or the second acquisition processing is executed with the first heating processing, it is possible to more rapidly start the printing.

The area of the circumscribed rectangle of the object data existing in the predetermined region is acquired as the area of the image, so that it is possible to define the area of the image at the time that the printing data is developed to the object data. Therefore, it is possible to increase the processing speed of the first acquisition processing or the second acquisition processing.

Since the target temperature in the first heating processing, which is executed with the first acquisition processing or the second acquisition processing, is set to the first temperature T1 lower than the fixing temperature TH, it is possible to suppress the heating member 81 from being uselessly heated when it has taken to execute the first acquisition processing or the second acquisition processing.

In the meantime, the present disclosure is not limited to the illustrative embodiment, and can be used in diverse forms as exemplified in the below. In below descriptions, the same configurations as the illustrative embodiment are denoted with the same reference numerals, and the descriptions thereof are omitted.

Figure 9:
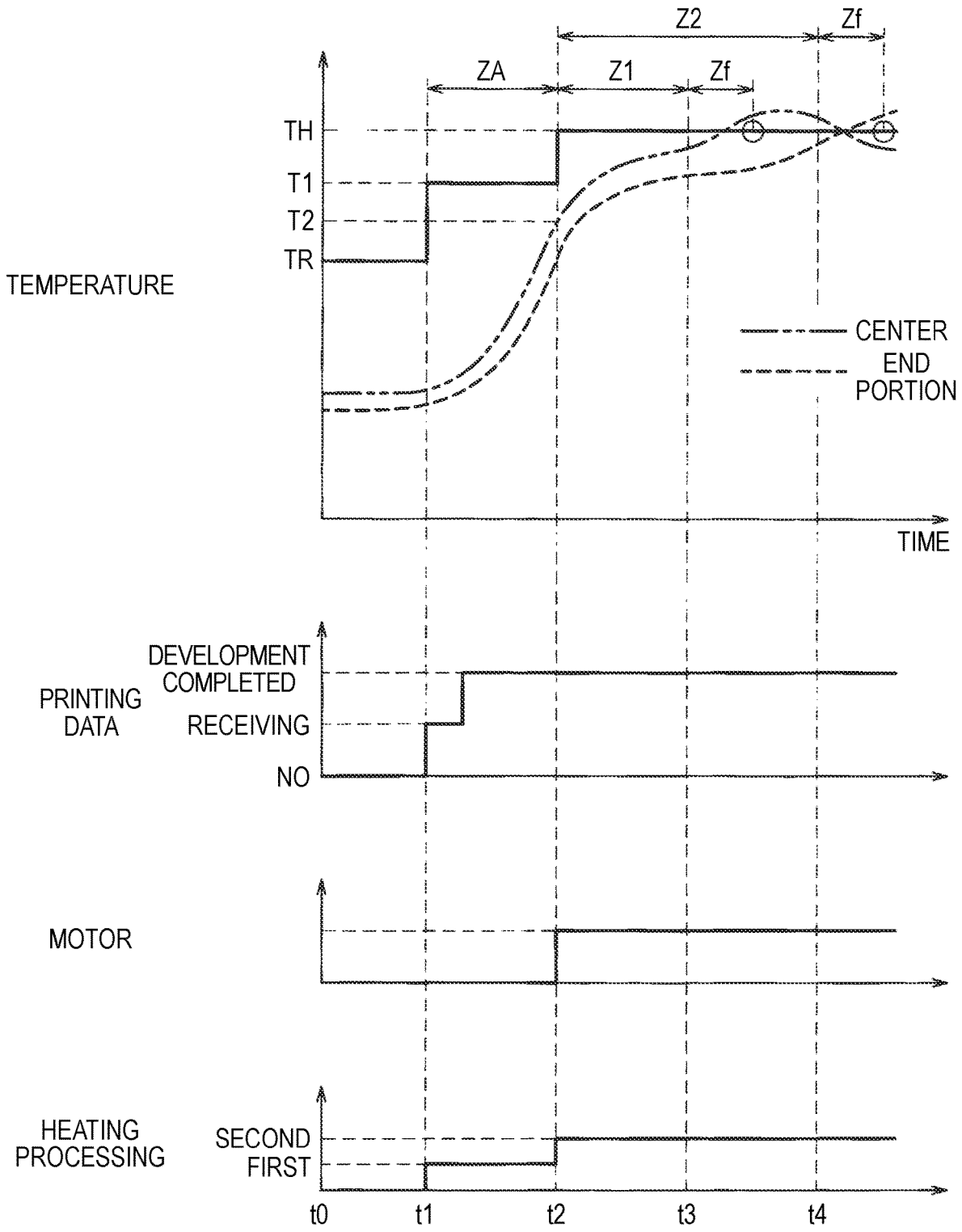
FIG. 9 is a timing chart depicting an operation of the controller in a situation where a temperature of a heating member is equal to or lower than a predetermined temperature.

In the illustrative embodiment, the operation of the controller 100 that is performed when the printing data is received in the ready mode has been exemplified. However, the present disclosure is not limited thereto. For example, as shown in FIG. 9, the present disclosure can be applied to a situation such as a sleep mode in which the temperature of the heating member 81 is equal to or lower than the predetermined temperature. The sleep mode is a state in which the predetermined period of time has elapsed after the previous printing is over and the energization to the heater 83 is stopped so as to reduce the power consumption. At this time, the heating member 81 is at a temperature lower than the ready temperature TR. Even when the printing data is received in the sleep mode, the controller 100 performs the same operation as the illustrative embodiment, so that the same effects can be accomplished. Meanwhile, in this case, the specified time ZA and the first time Z1 or the second time Z2 are preferably set to values different from the ready mode.

Figure 10A:
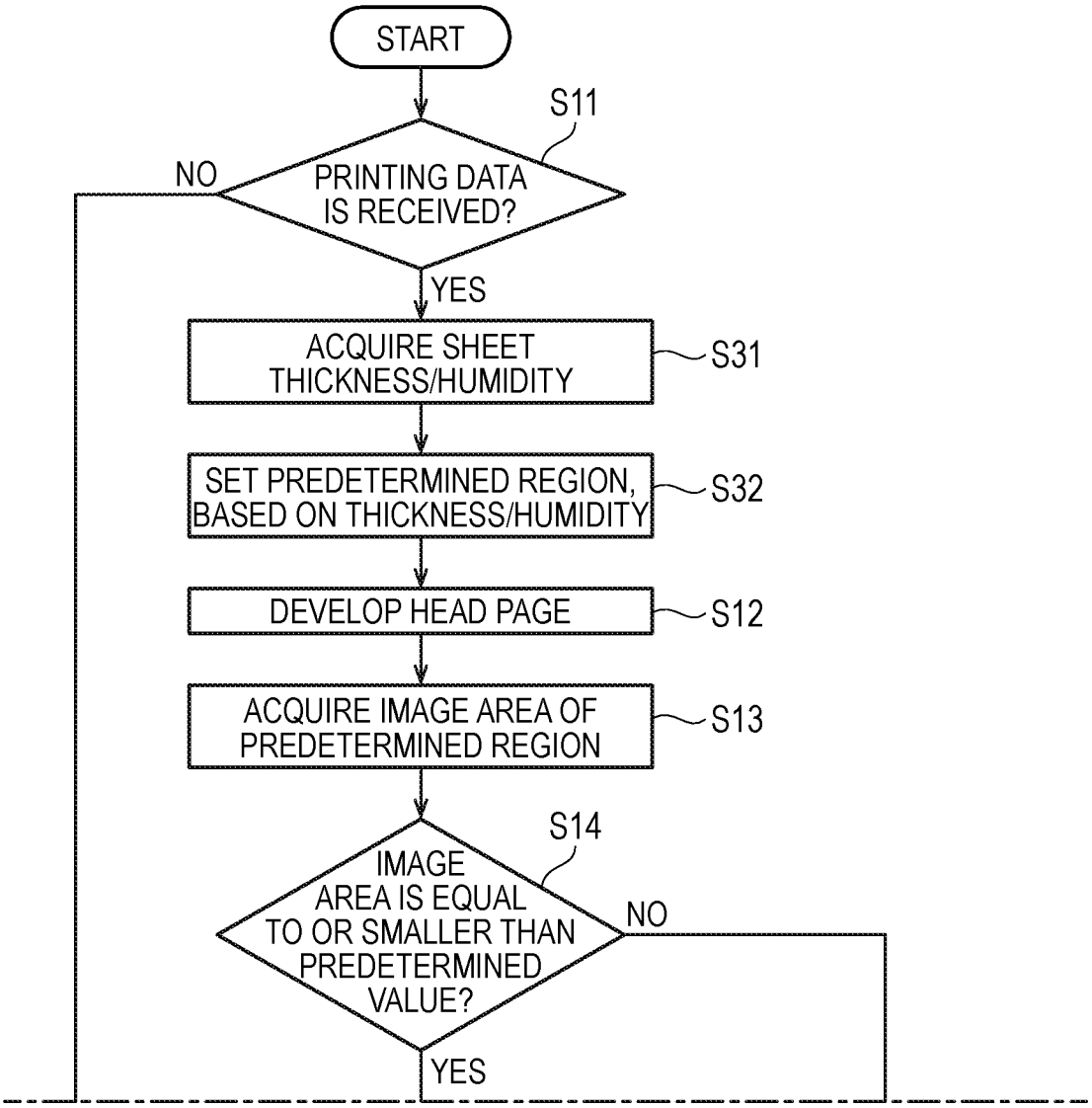
FIGS. 10A and 10B are flowcharts depicting an operation of the controller in a modified embodiment.
Figure 10B:
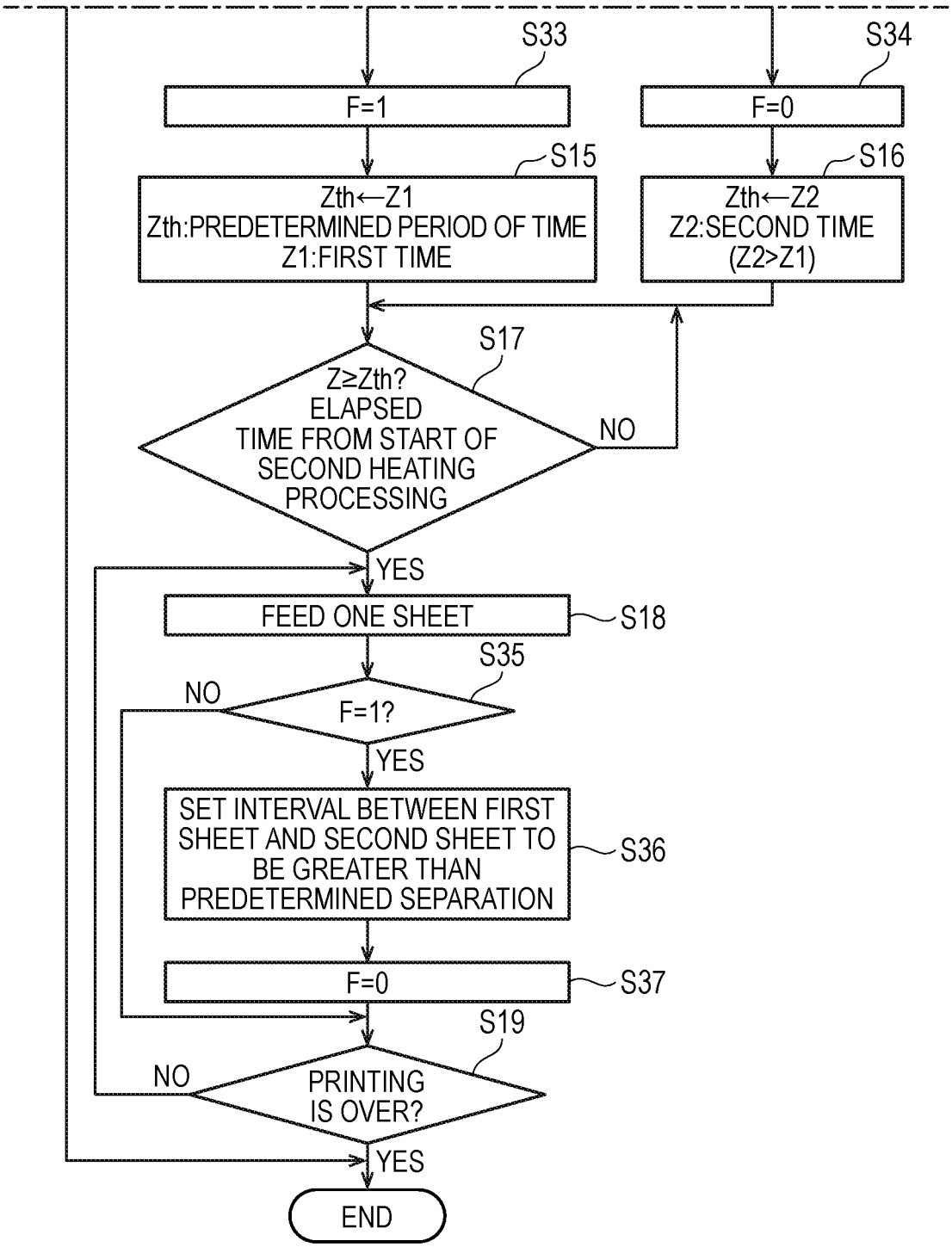

Also, in the illustrative embodiment, the predetermined region of the rear end portion of the page in the conveying direction and the interval between the sheets S for deciding the feeding timing of the second sheet S and thereafter have the fixed values. However, the present disclosure is not limited thereto. For example, the predetermined region and the interval between the sheets S may be changed, in correspondence to a condition. Specifically, the controller 100 may perform the control in accordance with a flowchart shown in FIGS. 10A and 10B. The flowcharts shown in FIGS. 10A and 10B have new steps S31 to S37, in addition to the processing of steps S11 to S19 of the flowchart shown in FIG. 7.

When it is determined in step S11 that the printing data has been received (Yes), the controller 100 executes processing of step S31. In step S31, the controller 100 acquires a thickness of the sheet S on the basis of the printing data and acquires a humidity from a humidity detector (not shown).

Figure 11:
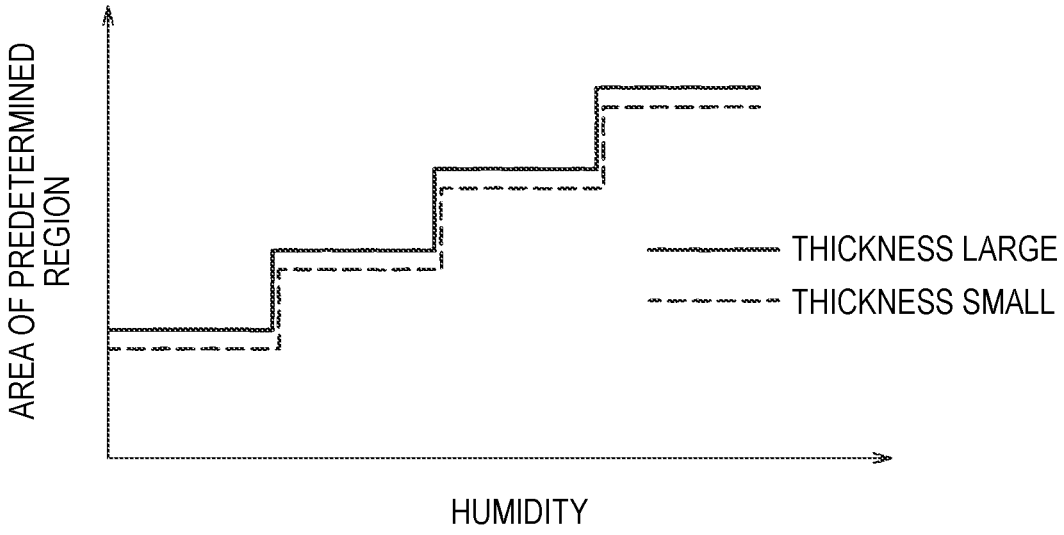
FIG. 11 depicts a predetermined region setting map.

After step S31, the controller 100 sets a predetermined region, based on the acquired thickness and humidity (S32). Specifically, in step S32, the controller 100 sets a predetermined region on the basis of a predetermined region setting map shown in FIG. 11, for example. The predetermined region setting map is a map indicative of a relation among an area of the predetermined region, the thickness and the humidity, and is appropriately prepared by a test and the like.

The predetermined region setting map is configured such that the greater the humidity or the thickness of the sheet S is, the predetermined region is set as a larger region (area). Here, the area of the predetermined region is changed by changing a length of the predetermined region in the conveying direction.

Returning to FIGS. 10A and 10B, after step S32, the controller 100 sequentially executes processing of step S12 to S14. When it is determined in step S14 that the area of the image in the predetermined region is equal to or smaller than the predetermined value (Yes), the controller 100 sets a flag F, which indicates that the predetermined period of time Zth is to be set to the short first time Z1, to 1 (S33), and then executes processing of step S15. When it is determined in step S14 that the area of the image in the predetermined region is not equal to or smaller than the predetermined value (No), the controller 100 sets the flag F to 0 (S34), and then executes processing of step S16.

After steps S15, S16, the controller 100 sequentially executes processing of steps S17, S18. After step S18, the controller 100 determines whether the flag F is 1 (S35).

When it is determined in step S35 that the flag F is 1 (F=1) (Yes), the controller 100 sets the interval between the first sheet S and the second sheet S to be greater than the predetermined separation (S36), and returns the flag F to 0 (S37). After step S37, the controller 100 executes processing of step S19, and returns to step S18 when it is necessary to print the second sheet S and thereafter (No).

In step S18, when the sheet interval has been changed to the larger interval in step S36, the controller 100 feeds the second sheet S at a feeding timing later than a normal timing corresponding to the predetermined separation. That is, when the predetermined period of time Zth is set to the short first time Z1, the controller 100 feeds the second sheet S such that the interval between the first sheet S and the second sheet S is larger than the predetermined separation. In the meantime, in step S18, the controller 100 feeds the third sheet S and thereafter at the feeding timing corresponding to the predetermined separation.

When it is determined in step S35 that the flag F is not 1 (F≠1) (No), the controller 100 skips over steps S36, 37 and executes processing of step S19. Thereby, when the predetermined period of time Zth is not set to the short first time Z1, the controller 100 sets the feeding timing of the second sheet S to the time corresponding to the predetermined separation.

According to the above modified embodiment, following effects can be accomplished.

The interval between the first sheet S and the second sheet S is increased, so that the time after the first sheet S is fixed until the second sheet S reaches the heating member 81 increases. Therefore, it is possible to sufficiently accumulate the heat in the heating member 81 for the increased time, so that it is possible to suppress a fixing defect from occurring on the second sheet S.

The greater the humidity or the thickness of the sheet S is, the heating member 81 or the pressing member 82 is more likely to be deprived of the heat by the sheet S. Therefore, when the humidity or the sheet thickness is greater, the predetermined region is set larger, so that it is possible to suppress a fixing defect from occurring on the first sheet S.

In the illustrative embodiment, the rear region in the conveying direction of the position distant by n times of the circumferential length of the pressing member 82, which is the pressing roller, is set as the predetermined region. However, the present disclosure is not limited thereto. For example, a rear region in the conveying direction of a position distant by n times of a circumferential length of the heating member 81, which is the heating roller, may be set as the predetermined region. However, since the pressing roller has the larger heat capacity and more contributes to the fixing performance, as compared with the heating roller, it is preferably to set the predetermined region on the basis of the circumferential length of the pressing roller.

In the illustrative embodiment, the predetermined timing is set to the time when the controller 100 starts the second heating processing. However, the present disclosure is not limited thereto. For example, the predetermined timing may be a time based on a predetermined state after the print processing starts. For example, the predetermined timing may be a time when the controller 100 starts the heating processing or a time when the temperature of the heating member reaches the second temperature T2 (refer to FIG. 9) lower than the fixing temperature after the heating processing starts.

In the illustrative embodiment, in the first acquisition processing and the second acquisition processing, the area of the circumscribed rectangle of the object data is acquired as the area of the image. However, the present disclosure is not limited thereto. For example, in the first acquisition processing and the second acquisition processing, the number of dots of an image in the predetermined region may be acquired as the area of the image.

In the illustrative embodiment, as the sheet feeder, the pickup roller 23 has been exemplified. However, the present disclosure is not limited thereto. For example, the sheet feeder may be any member capable of switching stop and conveyance of the sheet S by the controller 100. For example, the sheet feeder may be the registration rollers 29, a supply roller for feeding the sheet on a manual tray, or the like.

The sheet S may be a sheet such as a thick sheet, a postcard, a thin sheet and the like, an OHP sheet and the like.

A developer image forming unit is arbitrarily configured as the process unit. For example, a developer image forming unit configured to expose the photosensitive drum by a scanner configured to emit light, as the exposure device, is also possible.

In the illustrative embodiment, as the heating member 81, the cylindrical heating roller has been exemplified. However, the present disclosure is not limited thereto. For example, the heating member may be a nip plate configured to sandwich an endless belt between the nip plate and the pressing member.

In the illustrative embodiment, the motor M is rotated to rotate the heating member 81 and the pressing member 82, i.e., to drive the fixing device 80. However, the present disclosure is not limited thereto. For example, when the fixing device is coupled to the motor via a clutch, the controller may start driving the fixing device as the clutch becomes ON.

In the illustrative embodiment, as the heater 83, the halogen heater having the filament (resistive element) and configured to heat the heating member 81 by the radiation heat has been exemplified. However, the present disclosure is not limited thereto. For example, the heater 83 may be a ceramic heater having a resistive heat-generating element and configured to heat the heating member 81 by thermal conduction.

In the illustrative embodiment, the temperature detector 84 in contactless with the surface of the heating member 81 has been exemplified. However, the present disclosure is not limited thereto. For example, the temperature detector may be in contact with the surface of the heating member.

In the illustrative embodiment, the present disclosure has been applied to the color printer 1. However, the present disclosure is not limited thereto. For example, the present disclosure can be applied to the other image forming apparatus, for example, a monochrome printer, a copier, a complex machine and the like, too.

In the illustrative embodiment, the development processing of developing the printing data, and the first acquisition processing of acquiring the area of the image existing in the predetermined region of both end portions in the width direction of the first page of the printing data or the second acquisition processing of acquiring the area of the image existing in the predetermined region of the rear end portion in the conveying direction of the first page of the printing data are executed by the controller 100 of the color printer 1. However, the present disclosure is not limited thereto. For example, one or both of the development processing and the first acquisition processing or the second acquisition processing may be executed by a computer configured to transmit the printing data or an external device configured to perform communication.

Also, the respective elements described in the illustrative embodiment and the modified embodiments thereof may be implemented with being arbitrarily combined.

What is claimed is:

1. An image forming apparatus comprising:

a sheet feeder configured to feed a sheet;

a process unit configured to form a developer image on a sheet;

a heating member configured to heat a sheet; and a controller configured to, when the controller starts print processing, execute:

acquisition processing of acquiring an area of an image which exists in a predetermined region of a first page on which a developer image is first to be formed, the predetermined region being laid at both end portions in a width direction of the first page;

heating processing of heating the heating member such that a temperature of the heating member reaches a fixing temperature; and feeding processing of starting feed of a sheet to the process unit after a predetermined period of time elapses from a predetermined timing after a start of the print processing, wherein in a case where the area of the image existing in the predetermined region is equal to or smaller than a predetermined value, the controller sets the predetermined period of time in the feeding processing shorter as compared with a case where the area of the image is larger than the predetermined value.

2. The image forming apparatus according to claim 1, wherein the predetermined timing is a time when the controller starts the heating processing.

3. The image forming apparatus according to claim 1, wherein in the heating processing, the controller is configured to execute:

first heating processing of heating the heating member such that the temperature of the heating member reaches a first temperature lower than the fixing temperature, with executing the acquisition processing; and second heating processing of heating the heating member such that the temperature of the heating member reaches the fixing temperature, after the first heating processing is over.

4. The image forming apparatus according to claim 3, wherein the predetermined timing is a time when the controller starts the second heating processing.

5. The image forming apparatus according to claim 1, wherein the predetermined timing is a time when the temperature of the heating member reaches a second temperature lower than the fixing temperature after the heating processing starts.

6. The image forming apparatus according to claim 1, wherein the predetermined region is a rectangular region having a predetermined width from both ends toward a center of the first page in the width direction and having a range from a head to a rear end in a conveying direction.

7. The image forming apparatus according to claim 1, wherein the predetermined region is a region having a predetermined width from both ends toward a center of the first page in the width direction and having a predetermined length from a head of the first page in a conveying direction.

8. The image forming apparatus according to claim 1, wherein in the acquisition processing, the controller is configured to execute development processing of developing printing data being received to object data represented as vector data or bitmap data, and acquire an area of a circumscribed rectangle of the object data existing in the predetermined region as the area of the image.

9. The image forming apparatus according to claim 1, wherein the predetermined value is zero.

10. The image forming apparatus according to claim 1, wherein in the acquisition processing, the controller acquires a number of dots of the image as the area of the image.

11. An image forming apparatus comprising:

a sheet feeder configured to feed a sheet;

a process unit configured to form a developer image on a sheet;

a heating member configured to heat a sheet; and a controller configured to, when the controller starts print processing, execute:

acquisition processing of acquiring an area of an image which exists in a predetermined region of a first page on which a developer image is first to be formed, the predetermined region being laid at a rear end portion in a conveying direction of the first page and at least at a rear side with respect to a central portion in the conveying direction;

heating processing of heating the heating member such that a temperature of the heating member reaches a fixing temperature; and feeding processing of starting feed of a sheet to the process unit after a predetermined period of time elapses from a predetermined timing after a start of the print processing, wherein in a case where the area of the image existing in the predetermined region is equal to or smaller than a predetermined value, the controller sets the predetermined period of time in the feeding processing shorter as compared with a case where the area of the image is larger than the predetermined value.

12. The image forming apparatus according to claim 11, wherein the predetermined timing is a time when the controller starts the heating processing.

13. The image forming apparatus according to claim 11, wherein the predetermined timing is a time when the temperature of the heating member reaches a second temperature lower than the fixing temperature after the heating processing starts.

14. The image forming apparatus according to claim 11, wherein the predetermined region is a rectangular region having a predetermined length from a rear end toward a head of the first page in the conveying direction.

15. The image forming apparatus according to claim 11, wherein the predetermined region is a rectangular region having a predetermined length from a rear end toward a head of the first page in the conveying direction and having a predetermined width from both ends toward a center of the first page in a width direction.

16. The image forming apparatus according to claim 11, wherein in the acquisition processing, the controller is configured to execute development processing of developing printing data being received to object data represented as vector data or bitmap data, and acquire an area of a circumscribed rectangle of the object data existing in the predetermined region as the area of the image.

17. The image forming apparatus according to claim 11, wherein in the feeding processing, in a case where a plurality of sheets are printed, the controller is configured to control the sheet feeder to feed the sheets such that an interval between the sheets to be fed is a predetermined separation, and in a case where the predetermined period of time is set shorter as compared with a case where the area of the image is larger than the predetermined value, the controller is configured to the sheet feeder to feed the sheets such that an interval between a first sheet and a second sheet is larger than the predetermined separation.

18. The image forming apparatus according to claim 11, further comprising:

a pressing roller configured to press a sheet between the heating member and the pressing roller, wherein the predetermined region is at a rear side region in the conveying direction with respect to a position where is distant from a head of the first page in the conveying direction by n times of a circumferential length of the pressing roller.

19. The image forming apparatus according to claim 11, wherein the controller sets the predetermined region to a larger region as a humidity or a sheet thickness is greater.

20. An image forming apparatus comprising:

a sheet feeder configured to feed a sheet;

a process unit configured to form a developer image on a sheet;

a heating roller configured to heat a sheet;

a pressing roller configured to press a sheet between the heating roller and the pressing roller;

a halogen heater configured to heat the heating roller; and a controller configured to, when the controller starts print processing, execute:

acquisition processing of acquiring an area of an image which exists in a predetermined region of a first page on which a developer image is first to be formed, the predetermined region being laid at both end portions in a width direction of the first page;

heating processing of energizing the halogen heater such that a temperature of the heating roller reaches a fixing temperature; and feeding processing of starting feed of a sheet to the process unit after a predetermined period of time elapses from a predetermined timing after a start of the print processing, wherein in a case where the area of the image existing in the predetermined region is equal to or smaller than a predetermined value, the controller sets the predetermined period of time in the feeding processing shorter as compared with a case where the area of the image is larger than the predetermined value.

* * * * *